US006045171A

United States Patent [19]

McLeod et al.

[11] Patent Number: 6,045,171

[45] Date of Patent: Apr. 4, 2000

[54] SPEAR HEAD ASSEMBLY

[75] Inventors: Gavin T. McLeod, Bull Creek; Chris Saver, Balcatta, both of Australia

[73] Assignee: DHT Technologies Ltd., Perth, Australia

[21] Appl. No.: 09/068,399

[22] PCT Filed: Sep. 18, 1996

[86] PCT No.: PCT/AU96/00589

§ 371 Date: Dec. 7, 1998

§ 102(e) Date: Dec. 7, 1998

[87] PCT Pub. No.: WO97/18382

PCT Pub. Date: May 22, 1997

[30] Foreign Application Priority Data

Nov. 10, 1995 [AU] Australia ..... PN6518

[51] Int. Cl.[7] ..... E21B 31/00

[52] U.S. Cl. ..... 294/86.1; 294/86.13; 294/86.34; 166/98

[58] Field of Search ..... 294/86.1, 86.13, 294/86.14, 86.15, 86.16, 86.24, 86.34; 166/98, 99, 179, 206, 382

[56] References Cited

U.S. PATENT DOCUMENTS

| | | | |
|---|---|---|---|
| 2,333,802 | 11/1943 | Lowrey | 294/86.13 |
| 2,705,167 | 3/1955 | Layne et al. | 294/86.14 |
| 2,918,323 | 12/1959 | Coffee | 166/99 |
| 3,173,719 | 3/1965 | Ringler | 294/86.13 |
| 4,591,197 | 5/1986 | Akkerman | 294/86.24 |
| 5,201,814 | 4/1993 | Kitchell et al. . | |
| 5,392,851 | 2/1995 | Arend . | |

FOREIGN PATENT DOCUMENTS

| | | |
|---|---|---|
| 28306/92 | 5/1993 | Australia . |
| 2147336 | 5/1985 | United Kingdom . |
| 2291449 | 1/1996 | United Kingdom . |

*Primary Examiner*—Dean J. Kramer

[57] ABSTRACT

A spear head assembly (10) comprises a main body portion (14) with axially opposite first and second ends (16 and 18) respectively. The first end (16) is adapted for threaded connection with a down hole tool (12). The tool, which does not form part of the invention, is provided with an internal fluid flow path (13). Passage (20) is formed in the main body portion (14) and extends between first and second spaced apart openings $O_1$ and $O_2$ which are coincident with the first end and the second end (16 and 18) respectively of the main body portion (14). Spear point (22) is coupled to the main body portion (14) at, and extends from, the second end (18). In use, when the spear head assembly (10) is coupled to tool (12), to facilitate connection of the tool to a wireline and overshot via the spear point (22), the passage (20) is in fluid communication with the path (13). Therefore, fluid such as drilling mud can go through the path (13) in a substantially unimpeded manner.

29 Claims, 3 Drawing Sheets

SPEAR HEAD ASSEMBLY

FIELD OF THE INVENTION

The present invention relates to a spear head assembly typically for use in ground drilling.

BACKGROUND OF THE INVENTION

Spear head assemblies are well known in the art of ground drilling and are typically used to provide a releasable connection between, a running tool or other apparatus which is required to be lowered into and/or retrieved from a ground drill or bore hole, and; a wire line located at the ground surface. An overshot is attached to one end of the wire line which is able to selectively grab and then release a spear head assembly.

The spear head assembly is often formed integrally with the running tool or apparatus although sometimes it is formed as a separate unit and then attached to the tool or apparatus. Known spear head assemblies typically include a fixed spear point which extends in the axial direction and points upwardly for engagement with the overshot.

A difficulty encountered with the use of known spear head assemblies is that they tend to act as a plug and substantially reduce the flow of mud or other drilling fluids along or through the running tool or apparatus to which they are attached, or the drill pipe or bore in which they are disposed.

A further difficulty with known spear head assemblies is that when the running tool or apparatus to which they are attached is removed from the ground, very high loads are placed on a shank portion of the spear point and a jar bar of the overshot. These loads can cause bending or breakage of the shank and jar bar. This increases the cost of drilling due to increased down time and equipment costs. Moreover, in the case of breakage, personal injury and death can result as very heavy pieces of drilling equipment can fall uncontrollably.

SUMMARY OF THE INVENTION

It is a primary object of the present invention to provide a spear head assembly which is less restrictive to the flow of fluids when in use. It is a secondary object of the present invention to provide a spear head assembly which can reduce the loads placed on the weakest points of the spear point and/or an overshot coupled to the spear point.

According to the present invention there is provided a spear head assembly for connecting a running tool or other apparatus to a wire line, said running tool or other apparatus provided with a fluid flow path along or through which fluid can flow, said assembly comprising:

- a main body portion having first and second axially opposite ends, said first end adapted for coupling to said running tool or other apparatus, said main body portion being provided with an internal passage extending between first and second spaced apart openings, said first opening being at said first end; and,
- a spear point coupled to said main body portion and extending from said second end and adapted for coupling with said wireline;

whereby, in use, when said assembly is coupled between said running tool or other apparatus and said wireline, said passage can communicate with said fluid flow path to allow fluid to flow through said fluid flow path.

Preferably said spear point is pivotally coupled to said main body portion to allow pivotal motion of said spear point about an axis substantially perpendicular to a longitudinal axis of said main body portion.

Preferably said assembly further comprises releasable locking means disposed within said passage for releasably locking said spear point in a first position.

Preferably when said spear point is in said first position said spear point is substantially co-axial with said longitudinal axis.

Preferably said releasable locking means comprises first and second complimentary and mutually engagable locking parts and means for biasing said first and second parts into mutual engagement, wherein said first part is provided on said spear point, said second part is supported by said main body portion, and said means for biasing is provided in one of said spear point and main body portion.

Preferably said first part comprises a recess formed in said spear point shaped to receive said second part.

Preferably said second part comprises a transversely extending pin supported in said main body part in a manner to allow limited movement thereof in the direction of said longitudinal axis.

Preferably said main body portion is provided with diametrically opposed slots in which opposite ends of said pin are held.

Preferably said recess is substantially concave in profile and said pin has a surface portion for receipt in said recess which is of substantially convex profile.

Preferably said recess is formed with smoothly curved longitudinal edges.

Preferably said bias means comprises a coil spring disposed in said passage.

Preferably said main body portion comprises a cylindrical element having a cut-out formed at said second end, said cut-out running radially across said cylindrical element and extending in the axial direction thereof so as to form two spaced apart arms, and wherein said spear point is disposed between and pivotally coupled to said arms.

Preferably, said passage comprises an axial bore formed in said cylindrical element extending from said first end to said cut-out together with the space between said arms.

BRIEF DESCRIPTION OF THE DRAWINGS

An embodiment of the present invention will now be described by way of example only, with reference to the accompanying drawings in which.

DETAILED DESCRIPTION OF THE PREFERRED EMBODIMENT

As shown in the accompanying drawings, a spear head assembly 10 is shown for connecting a running tool or other apparatus 12 to a wireline via an overshot (not shown). The running tool or other apparatus 12 can include any type of tool or apparatus which is required to be lowered down through and then retrieved from a ground drill or bore. An example of such a running tool is shown in the applicant's co-pending International application no. PCT/AU94/00322 (WO 94/29567). The tool 12 typically includes an internal fluid flow path 13 through which drilling mud can flow when the tool 12 is being lowered into or retrieved from a drill pipe or bore.

Figure 3:
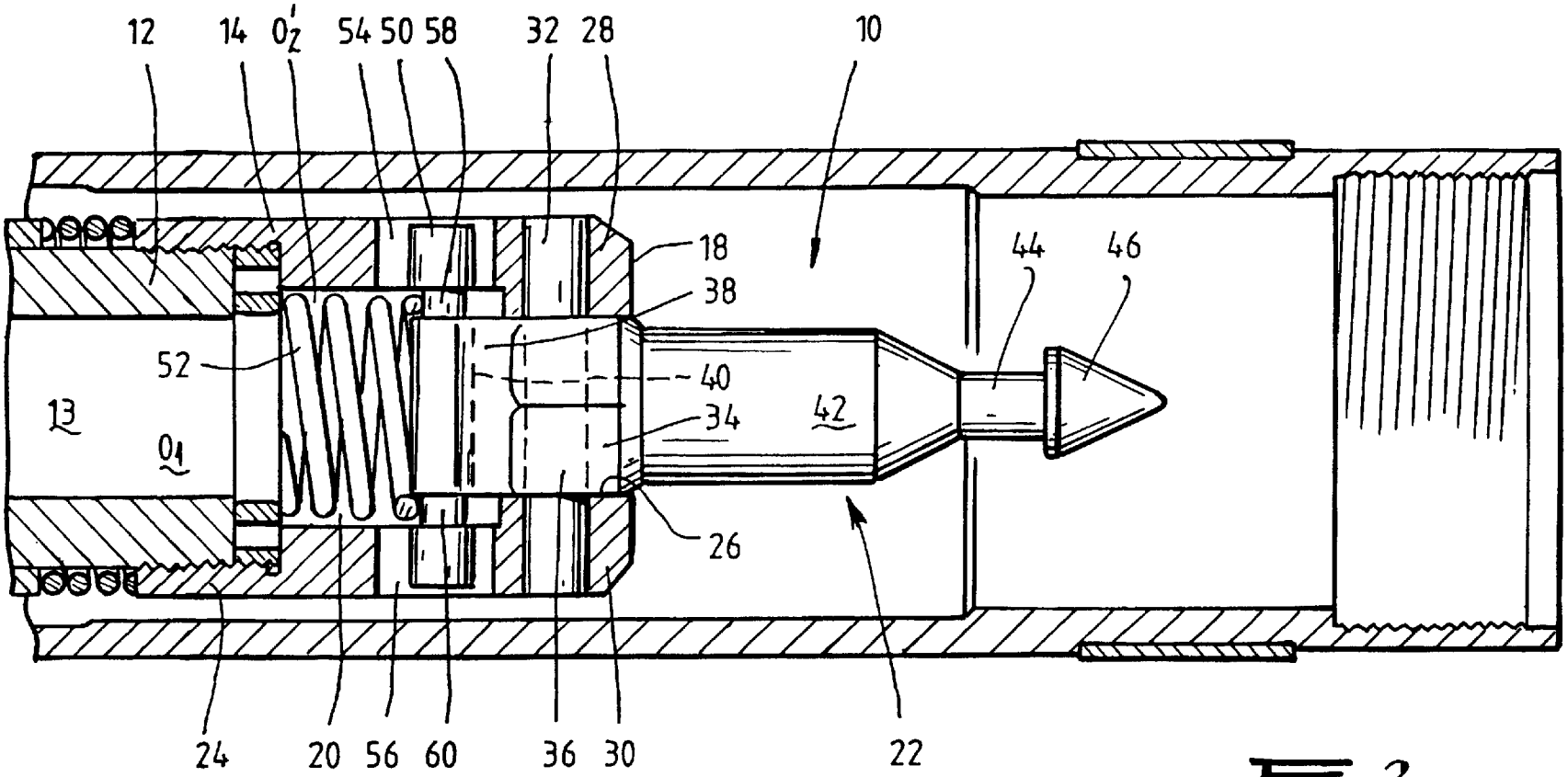
FIG. 3 is view of Section 3—3 of the spear head assembly shown in FIG. 2, when the spear head assembly is attached to a down hole tool; and, FIG. 4 is a view of Section 4—4 of the spear head assembly shown in FIG. 2 when attached to a down hole tool.

The spear head assembly 10 comprises a main body portion 14 with axially opposite first and second ends 16 and 18 respectively. As shown most clearly in FIGS. 3 and 4, the first end 16 is adapted for connection to the tool 12. This connection is typically provided by way of mutually engagable screw threads formed on the tool 12 and the inner circumferential surface of the main body portion 14 at the first end 16.

Passage 20 is formed in the main body portion 14 and extends between first and second spaced apart openings $O_1$ and $O_2$ which in this instance are coincident with the first and second ends 16 and 18, respectively of the main body portion 14. Spear point 22 is coupled to the main body portion 14 at, and extends from, the second end 18. In use, when the spear head assembly 10 is coupled to tool 12, to facilitate connection of the running tool 12 to a wireline and overshot via the spear point 22 the passage 20 is in fluid communication with path 13. Accordingly, fluid such as drilling mud can flow through path 13 in a substantially unimpeded manner.

The main body portion 14 comprises a cylindrical element 24 which is provided at the second end 18 with a cut-out 26 that runs across the radius of the cylindrical element 24 and has a depth which extends in the axial direction toward the first end 16. By virtue of the provision of the cut-out 26, two spaced apart arms 28 and 30 are formed at the second end 22.

The passage 20 comprises an axial bore formed in the cylindrical element 24 from the first end 16 to the arms 28, 30; together with the space between the arms 28 and 30.

Figure 2:
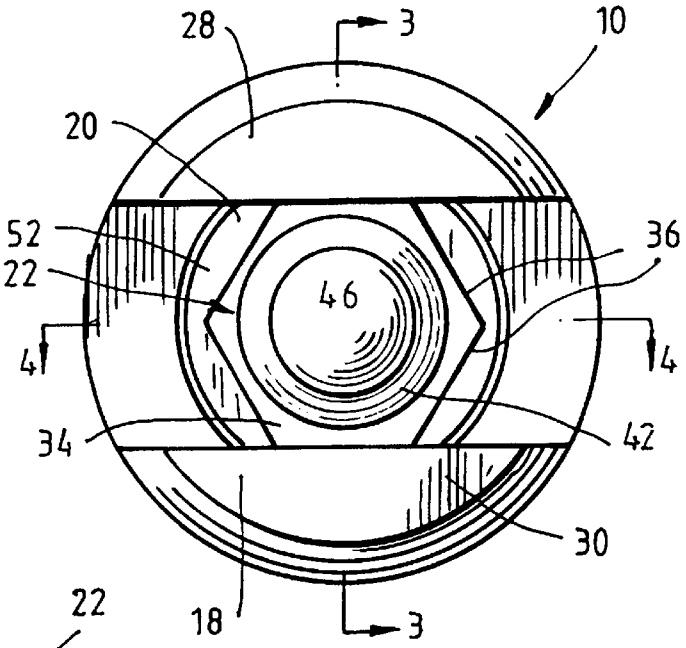
FIG. 2 is a front end view of the spear head assembly.
Figure 1:
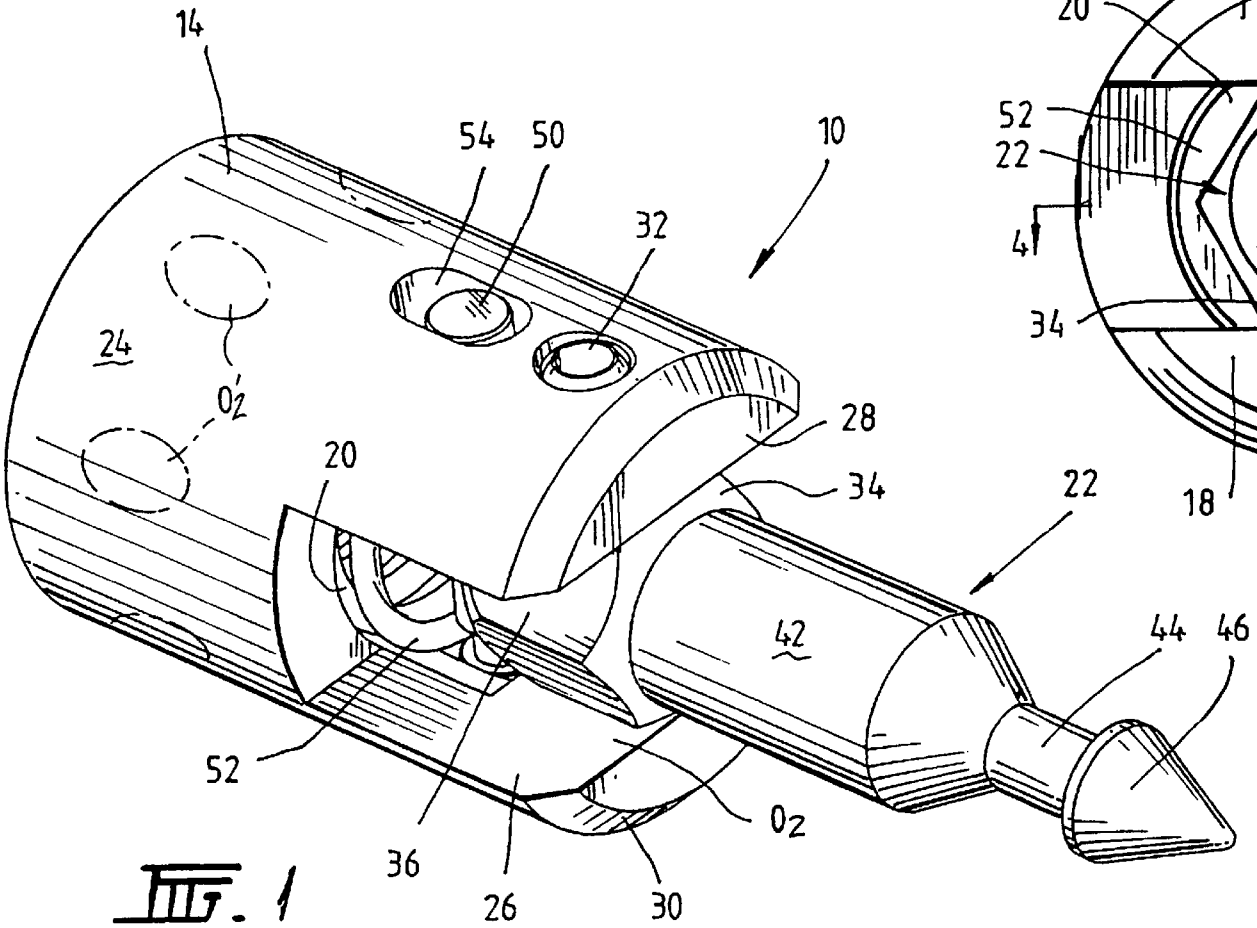
FIG. 1 is an isometric view of the spear head assembly.

Spear point 22 is pivotally coupled by pivot pin 32 to the main body portion 14. More particularly, the spear point 22 is disposed between the arms 28 and 30 and the pivot pin 32 passes transversely through the spear point 22. Opposite ends of the pin 32 are retained in arms 28 and 30 respectively. The pivot pin 32 allows the spear point 22 to be pivoted by 90° in opposite directions from a position coaxial with the longitudinal axis of the main body portion 14 (as shown in FIG. 1). That is, the spear point 20 can pivot through a total of 180°.

Spear point 22 comprises a base 34 having a hexagonal side surface 36 and a convex bottom surface 38. A concave recess 40 is formed in the bottom surface 38 which extends transverse to the length of spear point 22 and parallel with pivot pin 32. Extending from the base 34 opposite bottom 38 is a cylindrical extension 42 which tapers to a neck 44 of reduced, but constant diameter. Integrally formed with neck 44 is a conical point 46 which has a base adjacent the neck 44 of a diameter greater than that of the neck 44.

The spear head assembly 10 is provided with a releasable locking means which comprises, in combination, the concave recess 40, a locking pin 50 and, a biasing means in the form of a spring 52. Locking pin 50 extends parallel to the pivot pin 32 and has its opposite ends retained within elongate slots 54 and 56 formed in arms 28 and 30 respectively. The slots 54 and 56 extend parallel with the longitudinal axis of main body portion 14. Spring 52 is retained in the passage 20 and is arranged to abut the locking pin 50 at one end. In this regard, the locking pin 50 is provided with two circumferential grooves 58 and 60 to seat an uppermost turn of the spring 52 (refer FIG. 3). The lower end of the spring 52 is seated on the tool 12. The length of the spring 52 is chosen so that when the spear head assembly 10 is connected with the tool 12, the spring 52 biases the locking pin 50 into engagement with the bottom surface 38 of the spear point 22.

Figure 4:
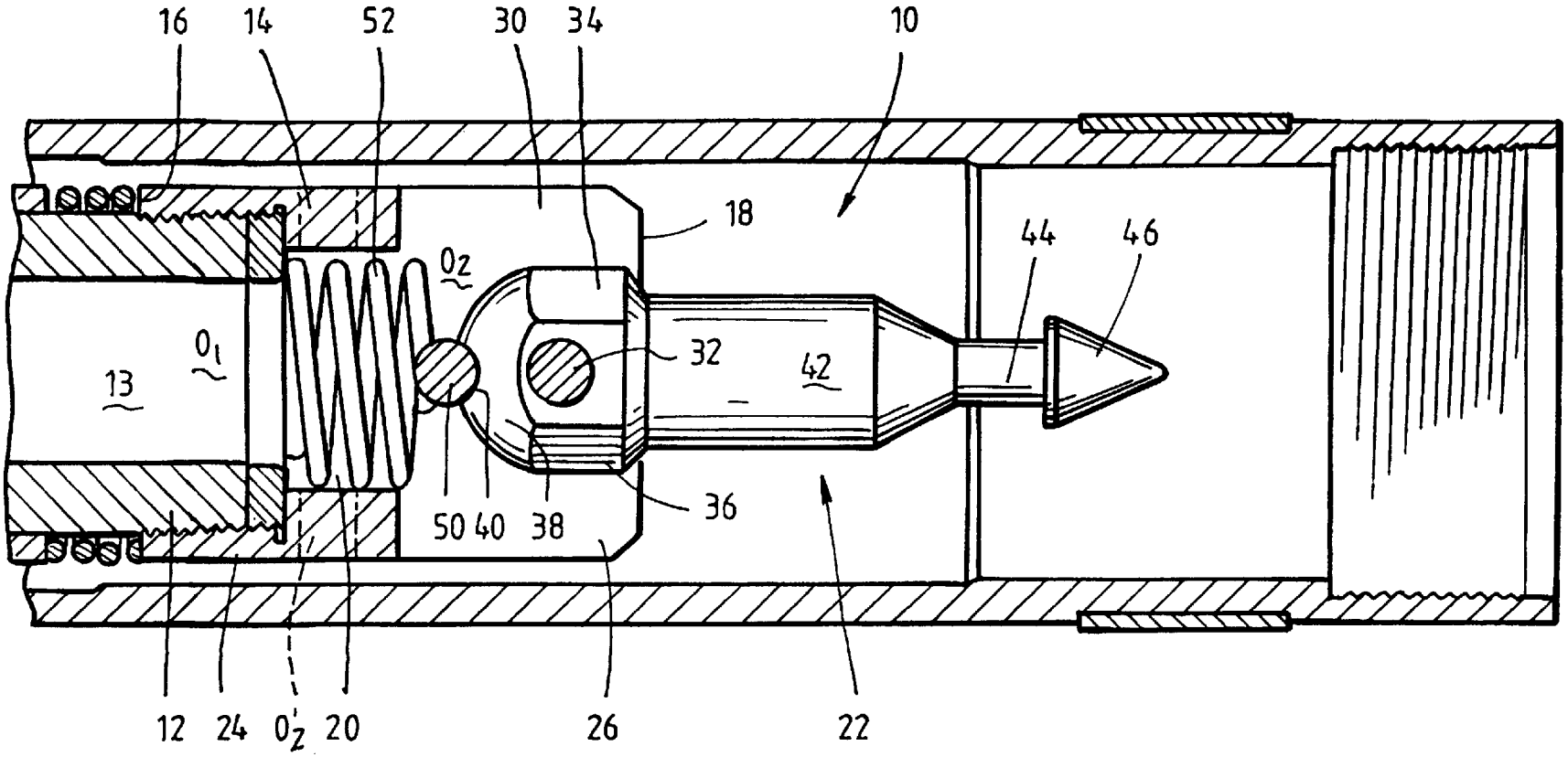

As is most evident from FIG. 4, the locking pin 50 includes a surface portion which is of complimentary shape to the recess 40 (ie. is convex in shape) so as to engage the recess 40 when the spear point 22 is in the coaxial position. In this way, the spear point 22 is releasably locked into the coaxial position but can be moved therefrom in response to a force applied in a direction transverse to the length of the pivot pin 22 provided that force is sufficient to overcome the bias of the spring 52. To assist in the pivoting motion of the spear point 22 and reduce wear, the recess 40 is formed with smoothly curved longitudinal edges.

From the above description, it will be apparent that the preferred embodiment has several benefits and advantages over the prior art spear head assemblies. Most significantly, the inclusion of the passage 20 allows tool 12 or other running tool or apparatus to which the spear head assembly 10 is connected to travel at greater speed down a drill pipe or bore as it allows mud or other drilling fluid to pass through the tools fluid flow path 13 in a substantially unimpeded manner. If the passage 20 were not present, as in the prior art, the spear head assembly would tend to act as a plug and cause the tool 12 to float very slowly down the drill pipe or bore. Also, the flow of drilling fluid is critical in maintaining operating temperatures in a desired range, lubricating moving parts, carry cuttings away from a drilling point and/or driving or otherwise powering down hole equipment. The provision of the passage 20 allows the maintenance and continuation of these functions of the drilling fluid in a substantially unhindered manner. Further, the provision of the pivoting spear point 20 assists in shifting the mechanical stresses and strains from the weakest points of a conventional spear head assembly and overshot coupling to areas of greater strength and durability.

Now that an embodiment of the invention has been described in detail it will also be apparent to those skilled in the relevant arts that numerous modifications and various may be made without departing from the basic inventive concepts. For example, the bottom surface 38 of the spear point 22 can be provided with a protrusion rather than a recess and the locking pin 50 provided with a recess for receiving that protrusion. Also, the spear head assembly 10 can be provided with a detachable base for holding the spring 52 within the passage 20 provided, of course, that base provided with an opening to allow the flow of fluid therethrough. Additionally, the second opening $O_2$, which is shown as being coincident with second end 18, can be formed on the outer circumferential surface (ie. the side) of the main body 14. In these circumstances, the opening $O_2$ may be one of a plurality of side openings on the main body, all of which communicated through the passage 20 with the first opening $O_1$. Such side openings are shown in phantom as openings $O_2$ in FIGS. 1 and 4. All such modifications and variations are deemed to be within the scope of the present invention the nature of which is to be determined from the foregoing description.

The claims defining the invention are as follows:

1. A spear head assembly for connecting a running tool or other apparatus to a wire line, said running tool or other apparatus provided with a fluid flow path along or though which fluid can flow, said assembly comprising:

a main body portion having first and second axially opposite ends, said first end adapted for coupling to said running tool or other apparatus, said main body portion being provided with an internal passage extending between first and second spaced apart openings, said first opening being at said first end; and a spear point coupled to said main body portion and extending from said second end, said spear point including a neck and an end portion having a base of a greater diameter than that of the neck, such that the base of the end portion forms at the neck a shoulder adapted to engage an overshot for coupling said assembly with said wire line;

wherein said internal passage is configured to communicate with said fluid flow path to allow fluid to flow through said fluid flow path when said assembly is coupled between said running tool or other apparatus and said wire line.

2. A spear head assembly according to claim 1, wherein said spear point is pivotally coupled to said main body portion to allow pivotal motion of said spear point about an axis substantially perpendicular to a longitudinal axis of said main body portion.

3. A spear head assembly according to claim 2, further comprising releasable locking means disposed within said passage for releasably locking said spear point in a first position.

4. A spear head assembly according to claim 3, wherein when said spear point is in said first position said spear point is substantially co-axial with said longitudinal axis.

5. A spear head assembly according to claim 4, wherein said releasable locking means comprises first and second complimentary and mutually engagable locking parts and means for biasing said first and second parts into mutual engagement, wherein said first part is provided on said spear point, said second part is supported by said main body portion, and said means for biasing is provided in one of said spear point and main body portion.

6. A spear head assembly according to claim 5, wherein said first part comprises a recess formed in said spear point shaped to receive said second part.

7. A spear head assembly according to claim 6, wherein said second part comprises a transversely extending pin supported in said main body part in a manner to allow limited movement thereof in the direction of said longitudinal axis.

8. A spear head assembly according to claim 7, wherein said main body portion is provided with diametrically opposed slots in which opposite ends of said pin are held.

9. A spear head assembly according to claim 8, wherein said recess is substantially concave in profile and said pin has a surface portion for receipt in said recess which is of substantially convex profile.

10. A spear head assembly according to claim 9, wherein said recess is formed with smoothly curved longitudinal edges.

11. A spear head assembly according to claim 10, wherein said bias means comprises a coil spring disposed in said passage.

12. A spear head assembly according to claim 1, wherein said main body portion comprises a cylindrical element having a cut-out formed at said second end, said cut-out running radially across said cylindrical element and extending in the axial direction thereof so as to form two spaced apart arms, and wherein said spear point is disposed between and pivotally coupled to said arms.

13. A spear head assembly according to claim 12, wherein said passage comprises an axial bore formed in said cylindrical element extending from said first end to said cut-out together with the space between said arms.

14. A spear head assembly according to claim 12, wherein said second opening is formed on an outer circumferential surface of said main body portion.

15. A spear head assembly according to claim 14, wherein said second opening is one of a plurality of second openings.

16. A spear head assembly for connecting a running tool or other apparatus to a wire line, said running tool or other apparatus provided with a fluid flow path along or though which fluid can flow, said assembly comprising:

a main body portion having first and second axially opposite ends, said first end adapted for coupling to said running tool or other apparatus, said main body portion being provided with an internal passage extending between first and second spaced apart openings, said first opening being at said first end; and a spear point coupled to said main body portion and extending from said second end and adapted for coupling with said wire line, said spear point being pivotally coupled to said main body portion to allow pivotal motion of said spear point about an axis substantially perpendicular to a longitudinal axis of said main body portion;

wherein said internal passage is configured to communicate with said fluid flow path to allow fluid to flow through said fluid flow path when said assembly is coupled between said running tool or other apparatus and said wire line.

17. A spear head assembly according to claim 16, further comprising releasable locking means disposed within said passage for releasably locking said spear point in a first position.

18. A spear head assembling according to claim 17, wherein when said spear point is in said first position said spear point is substantially co-axial with said longitudinal axis.

19. A spear head assembly according to claim 18, wherein said releasable locking means comprises first and second complimentary and mutually engagable locking parts and means for biasing said first and second parts into mutual engagement, wherein said first part is provided on said spear point, said second part is supported by said main body portion, and said means for biasing is provided in one of said spear point and main body portion.

20. A spear head assembly according to claim 19, wherein said first part comprises a recess formed in said spear point shaped to receive said second part.

21. A spear head assembly according to claim 20, wherein said second part comprises a transversely extending pin supported in said main body part in a manner to allow limited movement thereof in the direction of said longitudinal axis.

22. A spear head assembly according to claim 21, wherein said main body portion is provided with diametrically opposed slots in which opposite ends of said pin are held.

23. A spear head assembly according to claim 22, wherein said recess is substantially concave in profile and said pin has a surface portion for receipt in said recess which is of substantially convex profile.

24. A spear head assembly according to claim 23, wherein said recess is formed with smoothly curved longitudinal edges.

25. A spear head assembly according to claim 24, wherein said bias means comprises a coil spring disposed in said passage.

26. A spear head assembly for connecting a running tool or other apparatus to a wire line, said running tool or other apparatus provided with a fluid flow path along or though which fluid can flow, said assembly comprising:

a main body portion having first and second axially opposite ends, said first end adapted for coupling to said running tool or other apparatus, said main body portion being provided with an internal passage extending between first and second spaced apart openings, said first opening being at said first end, wherein said main body portion comprises a cylindrical element having a cut-out formed at said second end, said cut-out running radially across said cylindrical element and extending in the axial direction thereof so as to form two spaced apart arms; and a spear point coupled to said main body portion and extending from said second end and adapted for coupling with said wire line, wherein said spear point is disposed between and pivotally coupled to said arms;

wherein said internal passage is configured to communicate with said fluid flow path to allow fluid to flow through said fluid flow path when said assembly is coupled between said running tool or other apparatus and said wire line.

27. A spear head assembly according to claim 26, wherein said passage comprises an axial bore formed in said cylindrical element extending from said first end to said cut-out together with the space between said arms.

28. A spear head assembly according to claim 26, wherein said second opening is formed on an outer circumferential surface of said main body portion.

29. A spear head assembly according to claim 28, wherein said second opening is one of a plurality of second openings.

* * * * *